US007045731B2

(12) United States Patent
Schmidt et al.

(10) Patent No.: US 7,045,731 B2
(45) Date of Patent: May 16, 2006

(54) SWITCH CONTACT ARRANGEMENT WITH AN EROSION DISPLAY FOR THE SWITCH CONTACTS

(75) Inventors: Detlev Schmidt, Berlin (DE); Günter Seidler, Berlin (DE); Ingo Thiede, Berlin (DE); Sezai Türkmen, Berlin (DE); Artur Wajnberg, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/527,290

(22) PCT Filed: Jul. 30, 2003

(86) PCT No.: PCT/DE03/02591

§ 371 (c)(1),
(2), (4) Date: Mar. 8, 2005

(87) PCT Pub. No.: WO2004/027802

PCT Pub. Date: Apr. 1, 2004

(65) Prior Publication Data

US 2005/0224331 A1 Oct. 13, 2005

(30) Foreign Application Priority Data

Sep. 13, 2002 (DE) ..... 102 43 835

(51) Int. Cl.
*H01H 9/00* (2006.01)

(52) U.S. Cl. ..... 200/308; 200/244

(58) Field of Classification Search ..... 200/244–246, 200/335, 400; 218/18, 22; 335/6–8, 16, 335/147, 195

See application file for complete search history.

(56) References Cited

U.S. PATENT DOCUMENTS 6,150,625 A * 11/2000 Marchand et al. ..... 218/118
6,188,031 B1 * 2/2001 Turkmen ..... 200/244
6,225,585 B1 * 5/2001 Turkmen ..... 200/335

FOREIGN PATENT DOCUMENTS

DE 1 764 678 U 4/1958

(Continued)

OTHER PUBLICATIONS

Siemens, "Siemens 3WN6 AC Circuit-Breaker Operating Instructions", 1998, pp. 1-31, Order No. 3ZX1812-0WN60-0AN4 / 9239 9757 174, Siemens AG, Germany.

*Primary Examiner*—Elvin G Enad
*Assistant Examiner*—Lisa Klaus

(57) ABSTRACT

The invention relates to a switch contact arrangement with a first moving switch contact, with a second switch contact, provided for the first switch contact and with an erosion display, for the switch contacts. The erosion display comprises an erosion pointer and a display surface or display edge. The display pointer follows the movement of the first switch contact and, on closing the contacts, then only extends over the display surface or display edge when the value for the erosion of the switch contacts is less than a given maximum value. In order to be able to shorten the display pointer in the unused condition without a special tool to give a separation from the display surface or display edge, the value of which corresponds to the value of the maximum permitted erosion of the switch contacts, at least one marking for the cutting of the display pointer is provided, whereby the marking is separated from the display surface or display edge by the maximum permitted erosion of the switch contacts.

8 Claims, 3 Drawing Sheets

FOREIGN PATENT DOCUMENTS

| | | |
|---|---|---|
| DE | 1 092 101 | 11/1960 |
| DE | 10 92 101 B | 11/1960 |
| GB | 1 360 837 | 7/1974 |
| GB | 1 360 837 A | 7/1974 |

* cited by examiner

SWITCH CONTACT ARRANGEMENT WITH AN EROSION DISPLAY FOR THE SWITCH CONTACTS

CROSS REFERENCE TO RELATED APPLICATION

This application is the US National Stage of International Application No. PCT/DE2003/002591, filed Jul. 30, 2003 and claims the benefit thereof. The International Application claims the benefits of German Patent application No. 10243835.8 DE filed Sep. 13, 2002, both of the applications are incorporated by reference herein in their entirety.

FIELD OF THE INVENTION

The invention is in the area of electrical switches provided with a switch contact arrangement fitted with a first moving switch contact, and a second switch contact provided for the first switch contact, and is intended for use in the design and construction of an erosion display for the said switch contacts.

BACKGROUND OF THE INVENTION

In an older design of a switch contact arrangement known from document DE 17 64 678 U, an erosion display is provided in which an erosion pointer held against a moving contact by spring pressure is free to move in a guide. The end extending beyond the guide represents a measure of the contact erosion. Additionally a metal sheet can be fitted and provided with indicator markings against which the extent of the erosion can be read off. The metal sheet is fastened to the switch housing by means of an elongated hole and screws to position it precisely at a point of origin. This positioning must be carried out with the switch housing open by making fine adjustments to the sheet metal indicator, which adds up to a considerable amount of work if there is a number of circuit-breakers in a switch installation.

In a further known switch contact arrangement for a low-voltage circuit-breaker, the erosion display comprises an erosion pointer and a display surface or display edge. The erosion pointer follows the movement of the first switch contact and, with the contacts closed, then extends beyond the display surface or display edge only when the value for the erosion of the switch contacts is less than a given maximum value (Instruction Manual for Circuit-Breaker 3WN6, Siemens AG, Germany, 1998). In this known switch contact arrangement, the moving switch contact has a contact holder and a plurality of contact levers supported on the contact holder by means of contact force springs. The metal erosion pointer is supported on one of the contact levers and located in a hole drilled in the contact holder in the direction of force of the contact force spring. A recess in the contact holder serves as an inspection hole, one side of which opens to the drill hole, such that the end of the erosion pointer facing away from the contact lever only extends into the inspection aperture when there is a permitted amount of erosion on contact surfaces formed on the contact levers (contact members). If the value for the erosion on these contact surfaces is greater than the predefined maximum value, the erosion pointer no longer extends into this inspection hole. This then indicates that the switch contact arrangement needs to be renewed. When the worn switch contacts have been replaced with new switch contacts, a new erosion pointer must be inserted into the drill hole on the contact holder and must then be shortened with the contacts closed so that after shortening, its end pointing away from the contact lever extends into the inspection hole by the value predefined for the maximum erosion, for example 2.7 mm. This shortening requires a special tool which can be inserted into the very narrow inspection hole. Since fitters regularly exchange worn switch contact arrangements on the premises of operators of such electrical switches, the fitters must be in possession of this special tool.

Based on a switch contact arrangement with features according to the preamble of the claims (Instruction Manual for Circuit-Breaker 3WN6, Siemens AG, Germany, 1998) the object of the invention is to design the erosion display in a way that makes shortening the erosion pointer easier.

SUMMARY OF THE INVENTION

This object is inventively achieved in that at least one marking is provided for cutting the erosion pointer, whereby the marking is separated from the display surface or display edge by the maximum permitted erosion of the switch contacts.

By virtue of such a design, a new erosion pointer can be cut short at the marking by using ordinary, simple tools such as a slotted screwdriver. The on-site fitter therefore does not need an expensive special tool in order to shorten the erosion pointer with the switch contacts closed, at a point that is separated from the display surface or display edge by the maximum value predefined for the erosion.

According to the invention, the term erosion pointer means that element which is clearly visible when it extends beyond the display surface or display edge and which can be shortened without great technical effort, for instance by cutting. Such an element can have any kind of cross-section, such as polygonal, oval or round, and may also take the form of a stiff strip or tape. This element may be supported on the moving switch contact, directly or via a connecting link, or may be fastened to the moving switch contact, or designed as an integral component of the moving switch contact.

In a preferred embodiment of the innovative switch contact arrangement it is envisaged that the marking, in particular that for guiding the cutting edge of a tool, will take the form of a cutting surface or cutting edge. Using such a design the erosion pointer can be shortened accurately on the cutting edge or cutting surface without the need for any additional mark on the erosion pointer itself.

So that it will be easier to shorten the erosion pointer, it is envisaged that the erosion pointer will be made of plastic.

To provide support for the erosion pointer during cutting, and as a simple means of avoiding damage to the erosion pointer during shortening, a supporting surface can be provided running parallel to the erosion pointer.

In particular the low-voltage circuit-breaker known from the aforementioned instruction manual can also be provided with the innovative switch contact arrangement because the marking is formed by a first side of a second recess which is open to the first recess. In this case the supporting surface can be formed from a section of the drill hole open to the floor of the first recess. The second recess can form lateral guide surfaces for the tool used for cutting.

In an innovative switch contact arrangement built into an electrical switch, the erosion pointer can easily be adapted to the dimensional tolerances of the innovative switch contact arrangement by cutting the pointer as necessary. For this purpose an erosion pointer that extends beyond the marking when the switch contacts are closed merely has to be provided for the innovative switch contact arrangement and then cut off at the marking. An ordinary tool such as a slotted screwdriver can be used for cutting;

BRIEF DESCRIPTION OF THE DRAWINGS

A typical embodiment of a switch contact arrangement for an electrical switch in the form of a low-voltage circuit-breaker with the innovative erosion display is shown in FIGS. 1 to 7. These are as follows.

Figure 2:
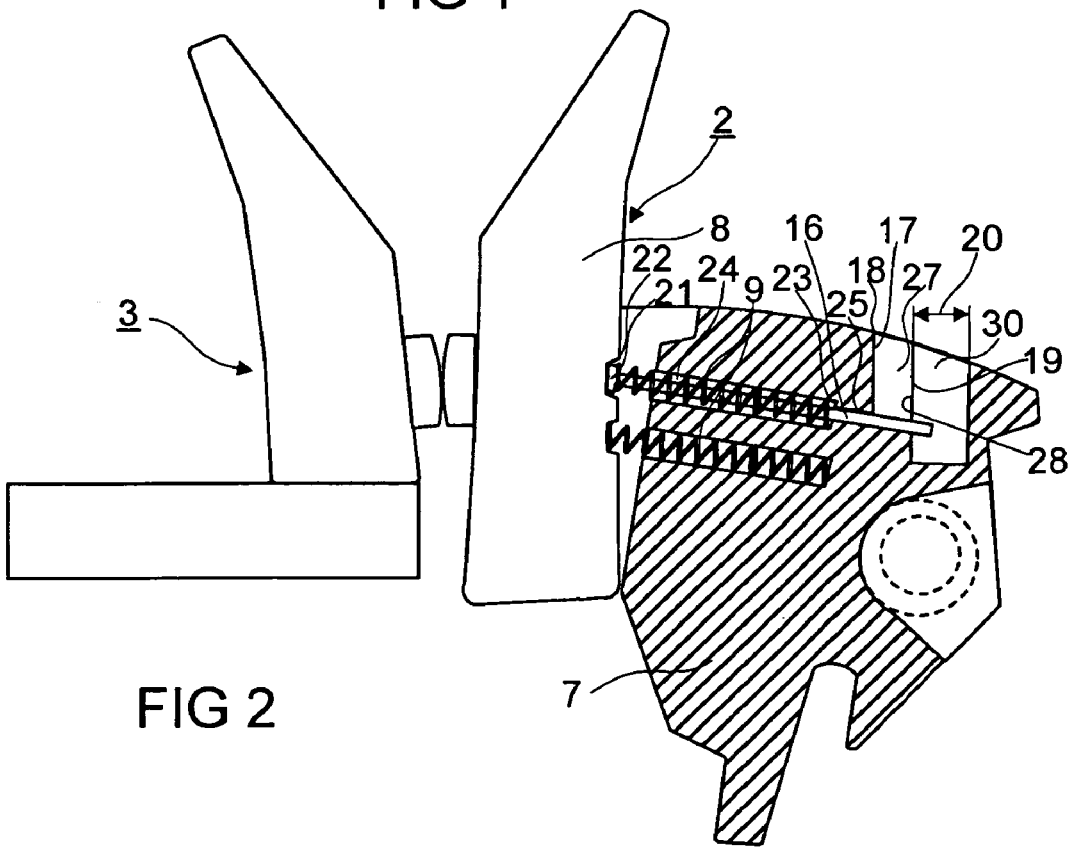
FIG. 2 shows the switch contact arrangement according to FIG. 1 as it first appears in its unused condition before the erosion pointer has been shortened.
Figure 3:
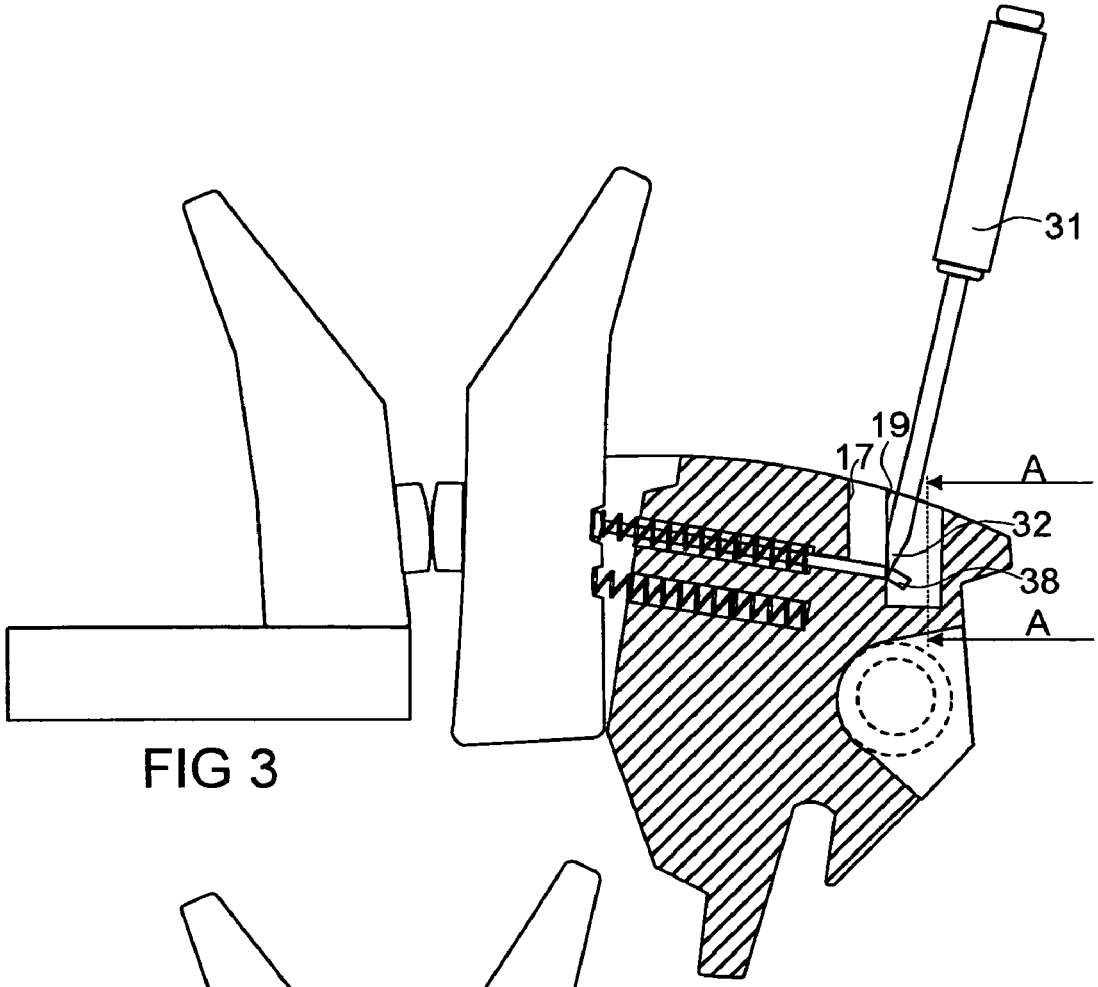
FIG. 3 shows the switch contact arrangement in its unused condition when the erosion pointer is being cut.
Figure 6:
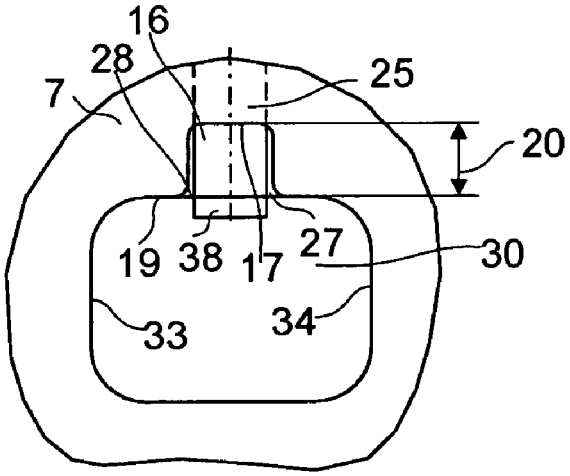
Figure 7:
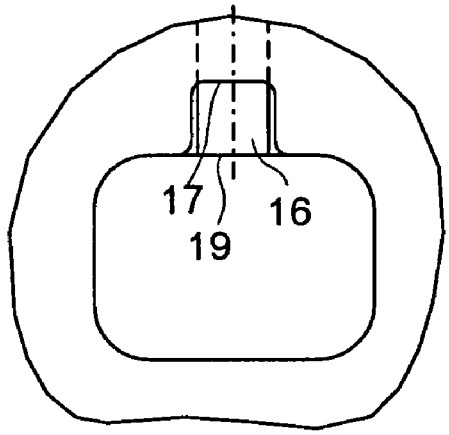

FIGS. 6 and 7 are a top view of a second section of the switch contact arrangement with the erosion pointer still not shortened as in FIG. 2, and with the erosion pointer cut as in FIG. 3.

DETAILED DESCRIPTION OF THE INVENTION

Figure 1:
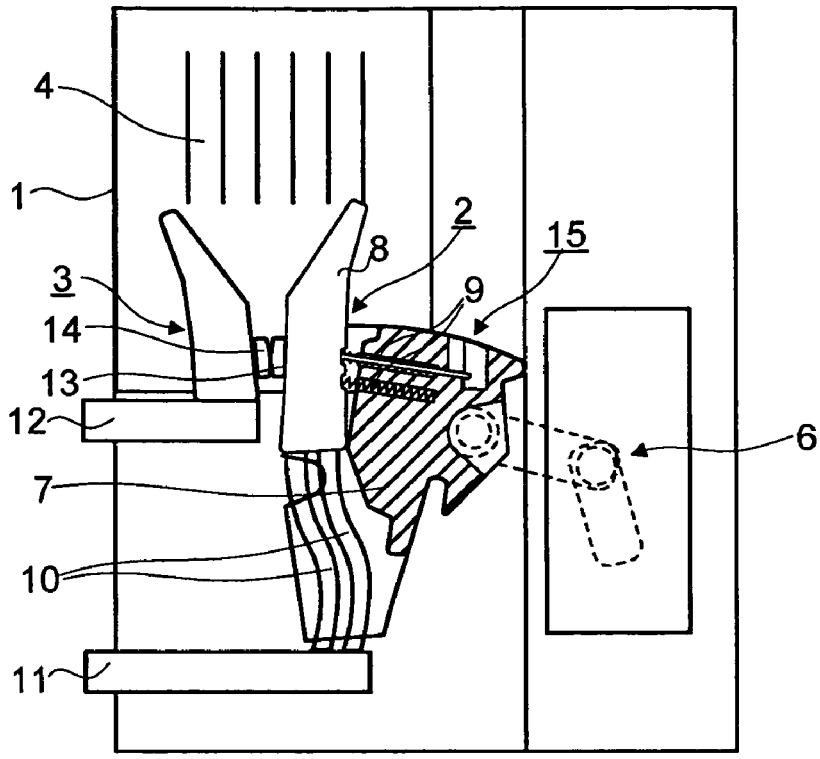
FIG. 1 is a diagram of a low-voltage circuit-breaker with a switch contact arrangement comprising an erosion display for switch contacts provided with contact surfaces.

The low-voltage circuit-breaker according to FIG. 1 has a housing 1 containing a switch contact arrangement (consisting of a moving switch contact 2 and a static contact 3), an arc quenching chamber 4 and a drive mechanism 6. The said drive mechanism 6 is used in this case to activate the moving switch contact 2, which has a plurality of contact levers 8 supported in a pivoting contact holder 7 and arranged parallel to each other (only one contact lever is visible in the figure). The contact levers 8 are pivotally attached in a known way to the contact holder 7 by a joint bolt and pre-tensioned by two contact force springs 9 each. Flexible conductors 10 serve to connect the contact levers 8 to a lower connecting bar 11. The static switch contact 3 associated with the moving switch contact 2 is connected to an upper connecting bar 12. The switch contacts 2, 3 are provided with contact surfaces 13, 14 (contact members) in the form of superimposed bodies made from a very special material, and consisting of sintered materials containing Ni, W and other special metals. Since these are comparatively expensive they are applied in relatively thin layers. The contact surfaces 13, 14 are still quite thick when the switch contact arrangement is in its unused condition, and its material is eroded by an electric arc. It is thus necessary to ensure that the contact surfaces are melted away fully. Therefore a certain value is specified as the maximum permitted erosion value, and the switch contact arrangement includes a display device 15 to display the current erosion value. When a new switch contact arrangement is fitted on the electrical switch operator's premises it is desirable that the erosion display can be set to the value specified for the maximum permitted erosion without a special tool.

For this purpose the erosion display according to FIG. 2 has a plastic erosion pointer 16, together with a display surface 17 or display edge 18 aligned at a first level, the erosion pointer 16 needing to be shortened, with the switch contacts 2, 3 closed, at a marking of the switch contact arrangement, said marking being in the form of a cutting surface 19. This cutting surface 19 is separated from the display surface 17 by a distance 20, the value of which corresponds to the specified maximum erosion value.

The newly inserted erosion pointer is supported on one of the contact levers 8. For this purpose the said pointer has a collar 21 at its end pointing toward the contact lever. This collar 21 fits into a pocket 22 in the contact lever. Between the collar and the far end 23 of a socket 24 for one of the contact force springs 9, the contact force spring 9 through which the erosion pointer 16 extends is pre-tensioned, holding the erosion pointer against the contact lever 8 in such a way that the pointer follows the movement of the contact lever. The far end 23 of the socket 24 for the contact force spring is the starting point of a drill hole 25 which extends through the contact holder 7 and is open both to a first side of a first recess 27 forming the display surface 17 and to the floor 35 of the first recess 27. This drill hole 25 serves as a guide for the erosion pointer 16. The value for the width of the first recess 27 in the direction in which the erosion pointer 16 moves is the same as the value of the distance 20, being the maximum permitted erosion value. On the side 28 which points away from the contact holder the drill hole is open to a first side of a second recess 30 which is also accessible from above. With the switch contacts 2, 3 closed, a new erosion pointer 16 extends beyond the first side of the second recess 30 used as the cutting surface 19 (cf. also FIG. 6).

According to FIG. 3, a slotted screwdriver 31 with its tapered end acting as a cutting edge 32 is pushed sharply downward onto the cutting surface 19 in order to cut the erosion pointer 16. For this purpose the side surfaces 33, 34 (cf. FIG. 6) of the second recess 30 act as guide surfaces for the screwdriver 31.

Figure 5:
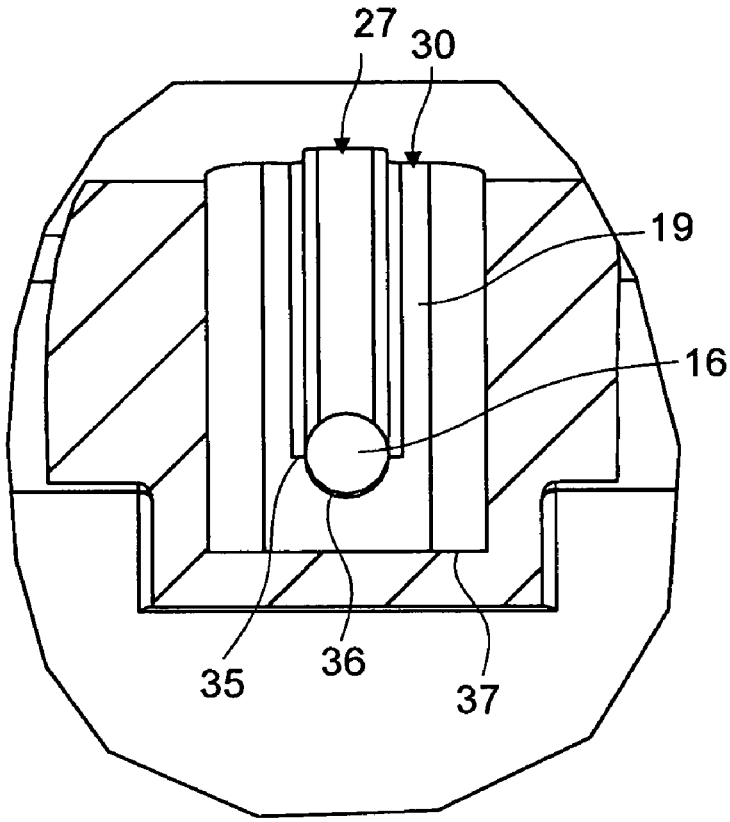
FIG. 5 is a sectional view of a first section of the switch contact arrangement along the line A—A in FIG. 3.

According to FIG. 5 a section of the drill hole open to the floor 35 of the first recess 27 forms a supporting surface 36 for the erosion pointer 16 during cutting. The floor 37 of the second recess is somewhat deeper, so that a part 38 (cf. FIGS. 3 and 6) of the erosion pointer 16 projecting beyond the cutting surface 19 can be cut completely. Other tools may also be used to remove the said part 38 by cutting, filing or some other means.

According to FIGS. 3 and 7, the end of the erosion pointer 16 is level with the cutting surface 19 after cutting, so that when the switch contact arrangement is in its unused condition said pointer exactly indicates the maximum permitted erosion value when viewed in relation to the display surface 17.

Figure 4:
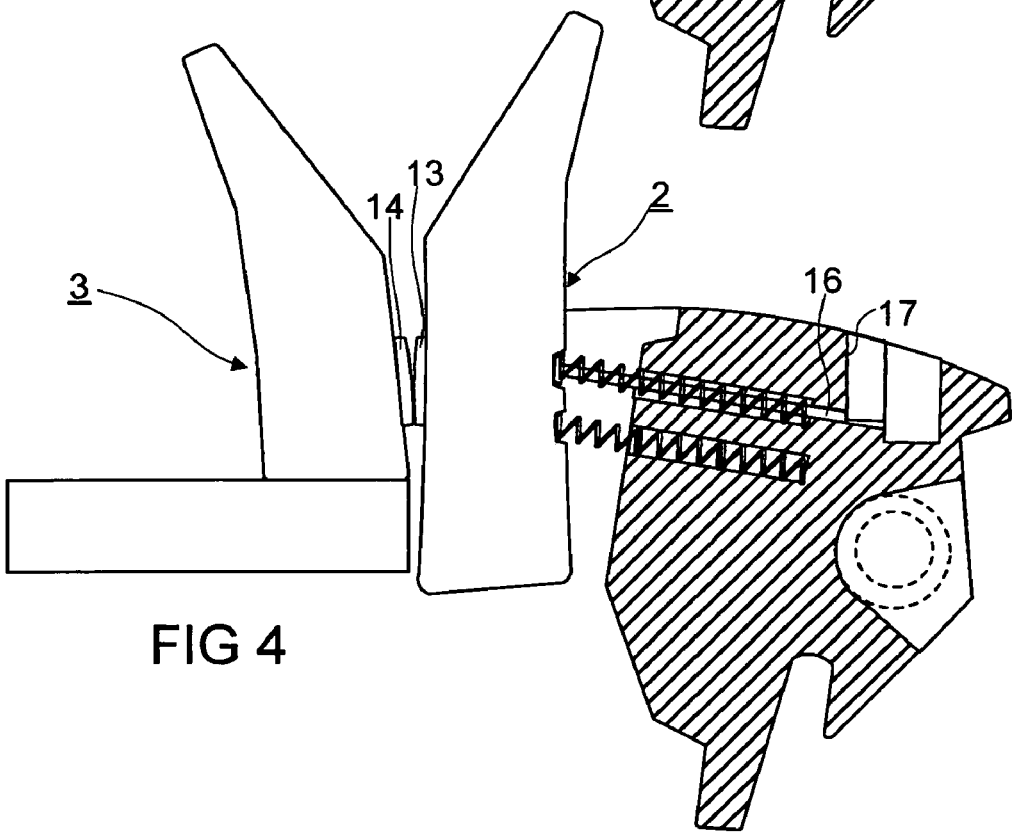
FIG. 4 shows the switch contact arrangement in the condition of maximum permitted erosion of the contact surfaces on the switch contacts.

According to FIG. 4, the end of the erosion pointer 16 is level with the display surface 17 and can therefore no longer be seen by an observer from above when the contact surfaces 13, 14 of the switch contacts 2, 3 have been burned away by the predefined maximum permitted value and the switch contact arrangement needs to be renewed.

The invention claimed is:

1. A switch contact arrangement, comprising:

a first moving switch contact;

a second switch contact, provided for the first switch contact;

an erosion display for the switch contacts, comprising:

an erosion pointer; and a display surface or display edge, wherein the erosion pointer follows the movement of the first switch contact and, with the contacts closed, extends beyond the display surface or display edge only when the value for the erosion of the switch contacts is less than a given maximum value; and a marking in the form of a cutting surface or cutting edge and is suitable for guiding the cutting edge of a tool and is provided for cutting the erosion pointer, whereby the marking is separated from the display surface or display edge by the maximum permitted erosion of the switch contacts.

2. The switch contact arrangement according to claim 1, wherein the erosion pointer is made from plastic.

3. The switch contact arrangement according to claim 1, wherein a supporting surface parallel to the erosion pointer is provided in order to support the erosion pointer during cutting.

4. The switch contact arrangement according to claim 1, wherein the moving switch contact has a contact holder and a contact lever supported on the contact holder by a contact force spring and the erosion pointer of the erosion display is free to slide in a drill hole that acts as a guide in the contact holder, such that the display surface or display edge is formed by a first side, open to the drill hole, of a first recess in the contact holder, and the marking is formed by a first side of a second recess which is open to the first recess.

5. The switch contact arrangement according to claim 4, wherein the supporting surface is formed by a section of the drill hole, and said section being open to the floor of the first recess.

6. The switch contact arrangement according to claim 4, wherein the second recess forms lateral guide surfaces for the tool.

7. A method for cutting an erosion pointer in a switch contact arrangement, comprising:

providing an erosion pointer that extends beyond a marking when a first and second switch contacts are closed; and cutting the erosion pointer at the marking.

8. The method for cutting an erosion pointer according to claim 7, wherein a slotted screwdriver is used as a tool for cutting.

* * * * *